US007891628B2

(12) United States Patent
Dubois et al.

(10) Patent No.: US 7,891,628 B2
(45) Date of Patent: Feb. 22, 2011

(54) LOAD CARRIER

(75) Inventors: Jean-Marc Dubois, Bremgarten (CH); Juergen Straub, Albershausen (DE); Christian Mathews, Linkenheim-Hochstetten (DE)

(73) Assignee: George Utz Holding AG, Bremgarten (DE)

( * ) Notice: Subject to any disclaimer, the term of this patent is extended or adjusted under 35 U.S.C. 154(b) by 0 days.

(21) Appl. No.: 12/384,760

(22) Filed: Apr. 8, 2009

(65) Prior Publication Data

US 2009/0249985 A1 Oct. 8, 2009

(30) Foreign Application Priority Data

Apr. 8, 2008 (DE) ..... 10 2008 017 924
Apr. 24, 2008 (DE) ..... 10 2008 020 431

(51) Int. Cl.
*A47B 91/00* (2006.01)

(52) U.S. Cl. ..... 248/346.02

(58) Field of Classification Search ..... 248/346.02, 248/346.01, 346.11; 108/55.5, 56.3, 51.11; 206/599, 597, 335
See application file for complete search history.

(56) References Cited

U.S. PATENT DOCUMENTS

| | | | | | |
|---|---|---|---|---|---|
| 3,104,085 | A * | 9/1963 | Skladany | 410/49 |
| 3,699,902 | A * | 10/1972 | Allgeyer et al. | 108/57.26 |
| 3,951,078 | A * | 4/1976 | Fowler et al. | 108/57.28 |
| 4,606,278 | A * | 8/1986 | Shuert | 108/57.27 |
| 5,029,734 | A * | 7/1991 | Nichols | 222/105 |
| 5,423,428 | A * | 6/1995 | Selz | 206/597 |
| 2002/0145143 | A1* | 10/2002 | Kawasaki et al. | 257/72 |
| 2007/0151488 | A1* | 7/2007 | Schader | 108/51.3 |
| 2007/0227406 | A1* | 10/2007 | Korbonski | 108/11 |
| 2008/0256777 | A1* | 10/2008 | Dubois | 29/450 |
| 2010/0059406 | A1* | 3/2010 | Ng | 206/600 |

* cited by examiner

*Primary Examiner*—Ramon O Ramirez
(74) *Attorney, Agent, or Firm*—Collard & Roe, P.C.

(57) ABSTRACT

A load carrier has a rectangular bottom part and feet disposed at least in the corner regions of the bottom part. A groove for accommodating a load-securing belt is provided above the feet, encircling the bottom part. The front edge of each corner foot projects beyond the related bottom corner edge, and a nub-like elevation is provided on this projecting front edge.

6 Claims, 4 Drawing Sheets

LOAD CARRIER

CROSS REFERENCE TO RELATED APPLICATIONS

Applicants claim priority under 35 U.S.C. §119 of German Application No. 10 2008 017 924.8 filed Apr. 8, 2008 and German Application No. 10 2008 020 431.5 filed Apr. 24, 2008.

BACKGROUND OF THE INVENTION

1. Field of the Invention

The invention relates to a load carrier having a rectangular bottom part and feet disposed at least in the corner regions of the bottom part. A groove for accommodating a load-securing belt is provided above the feet, encircling the bottom part.

2. The Prior Art

Such load carriers can be pallets, collapsible pallet boxes, or also rigid pallet boxes. These load carriers are produced from plastic, using the injection-molding method. The feet can be directly injection-molded on, but can also be screwed on afterwards.

Additional feet can also be formed between the corner feet, at least on the long sides of the pallets or load carriers, and these feet can also be connected with one another by means of runners.

During transport, such load carriers have to be secured to prevent slipping. Load-securing belts that are looped into a corresponding groove, around the load carrier, and attached to the vehicle, serve this purpose.

SUMMARY OF THE INVENTION

It is an object of the invention to provide a load carrier in which the belt is prevented from slipping out of the groove when it is under strain. To accomplish this task, the front edge of each corner foot projects beyond the related bottom corner edge, and a nub-like elevation is provided on this projecting front edge.

This nub-like elevation therefore serves as a barrier, over which the belt cannot slip, even if it is loosened. To stabilize the nub-like elevation, and to protect against wear, a screw that reaches into the corner foot, perpendicular to the ground, is inserted into the elevation, through its peak point, and the head of this screw forms the upper elevation cover.

This screw is screwed correspondingly deeply into the foot, so that it has a good hold and gives the nub-like elevation corresponding stability. In this connection, the metallic head of the screw serves as wear protection.

This elevation can be a formed part provided on the front edge of the corner foot and integrated into the corner foot. This means that the nub-like formation is part of the front edge surface.

The elevation can also be a separate part and be disposed below the screw head. The screw is screwed into a thread introduced perpendicularly into the corner foot.

This therefore means that here, the front edge surface forms a plane in which the threaded opening is provided. The load-belt securing mechanism is formed by the screw-elevation combination in this alternative, as well.

The second function of the screw is for holing a flexible tab that reaches up to the bottom corner edge and lies on it with its free end. This tab serves as an additional securing mechanism for the attachment belt. The end of the tab is angled away a little to the outside, so that the belt can easily be pressed down from above, against the elastic force of the tab. It is secured in its position in the groove, with the help of the tab and the nub-like elevation.

The corner feet can be configured as sleeves made of a wear-resistant material, which can be set on by way of foot stumps that are formed onto or screwed onto the bottom of the load carrier. This embodiment is particularly advantageous if heavy goods are being stored and transported on the pallets, and the pallet feet are subject to great stress, since the load carriers are generally moved, particularly pushed, on rough warehouse floors, using forklift trucks.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
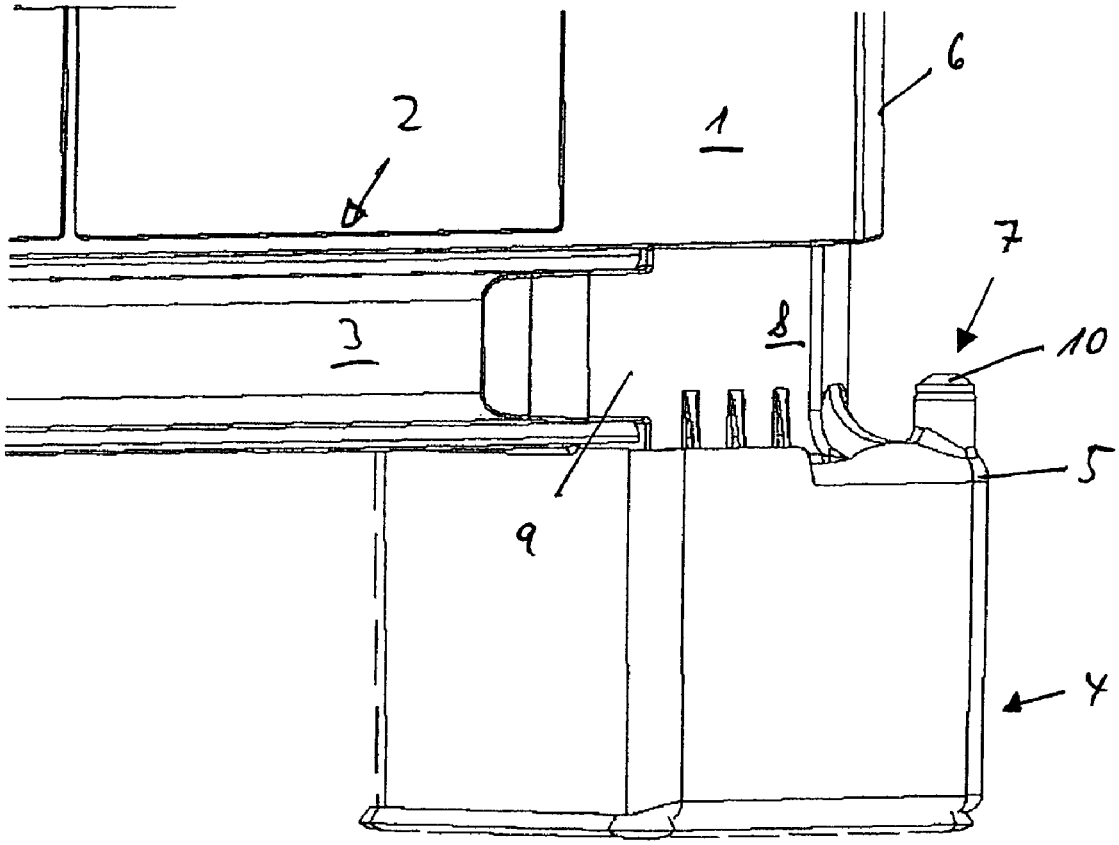
FIG. 1 shows the corner region of a load carrier according to one embodiment of the invention, with a corner foot.
Figure 2:
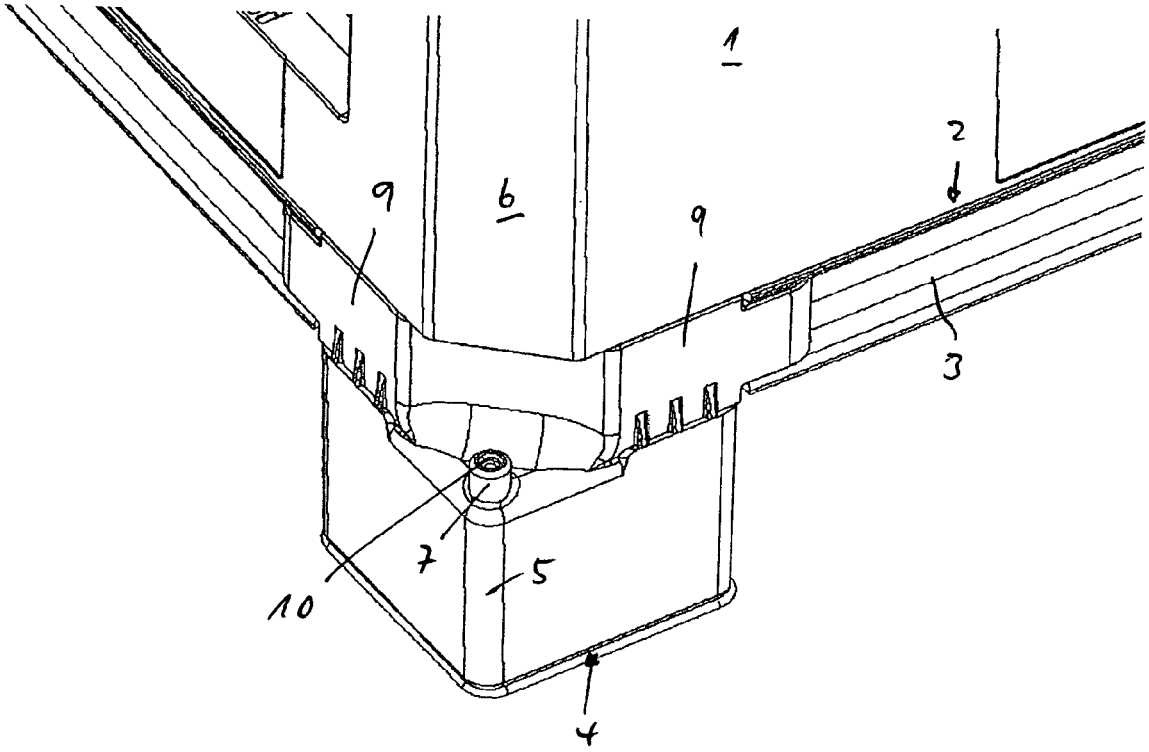
FIG. 2 shows a corner region of the load carrier according to FIG. 1, seen at a slant from above.
Figure 3:
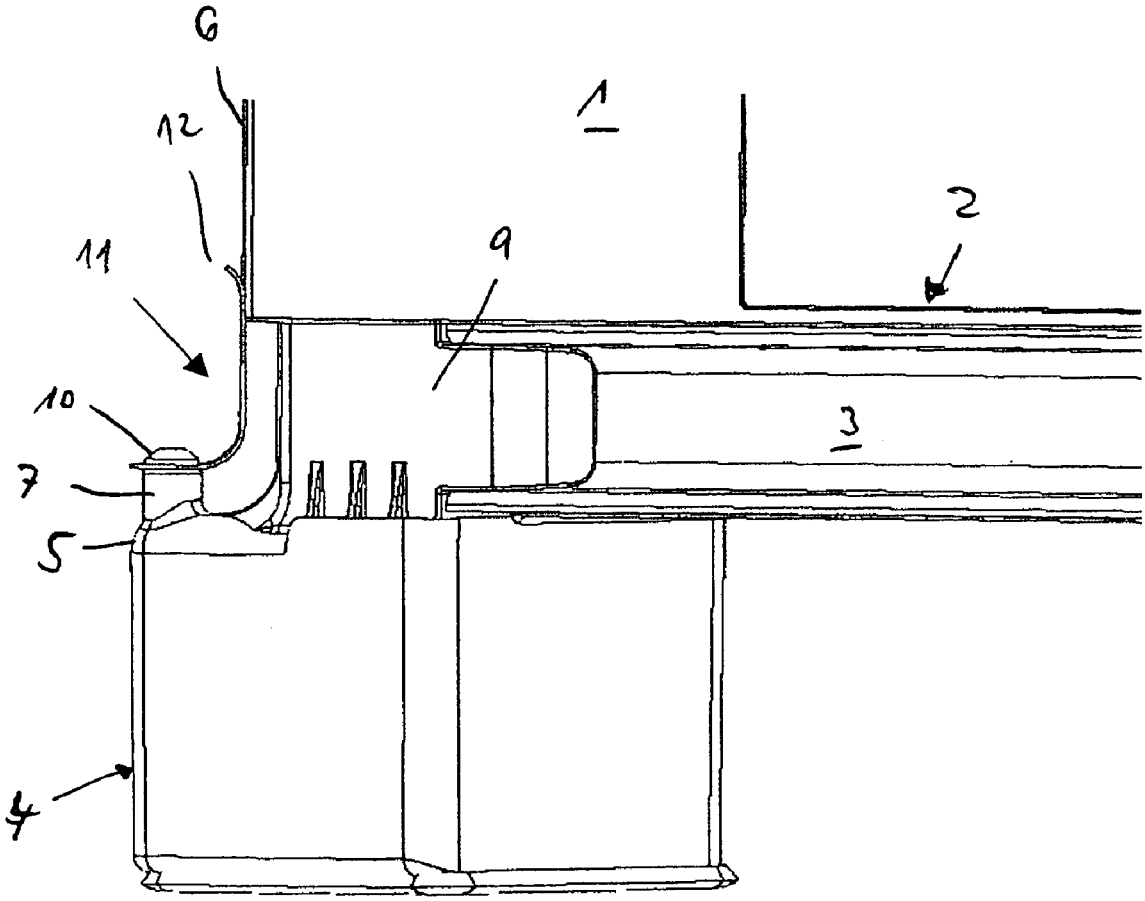
FIG. 3 shows a corner region of a load carrier according to an embodiment of the invention having a tab-like belt securing mechanism.
Figure 4:
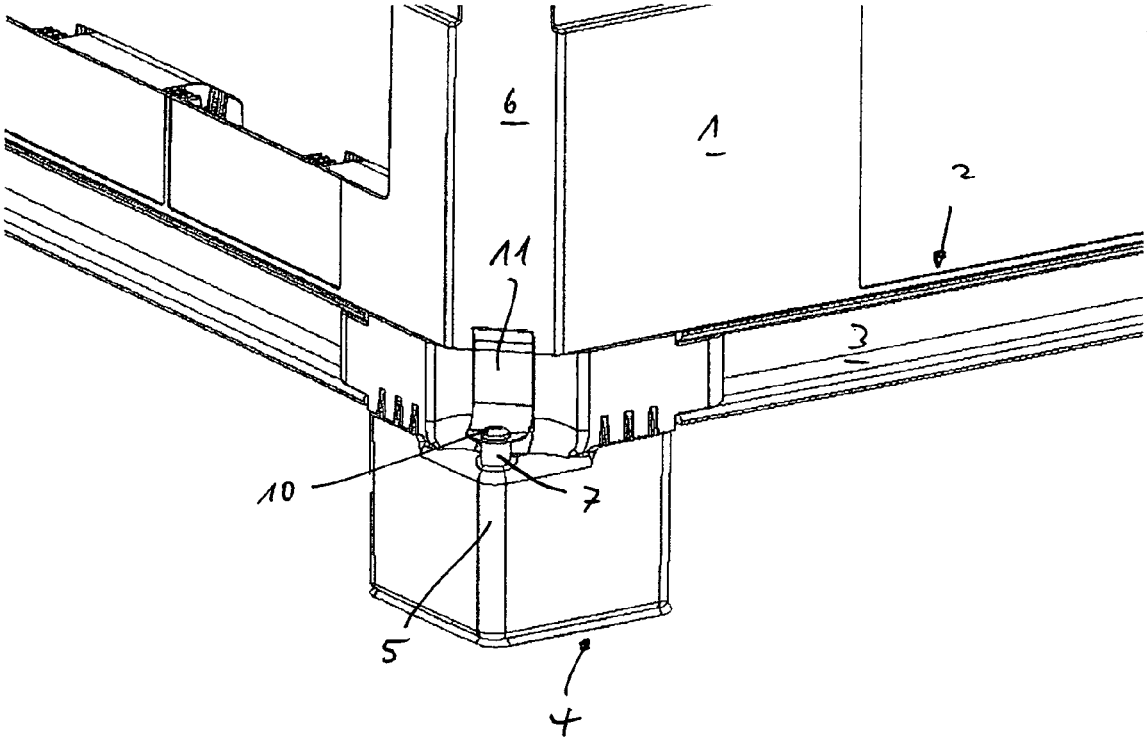
FIG. 4 shows a corner region of a load carrier according to FIG. 3, in a slanted view from above.

In FIGS. 1 to 4, the corner region of a load carrier (for example, a pallet) is shown in perspective representations. Pallet 1 consists of a rectangular bottom part 2, which is surrounded by a groove 3 that runs around the circumference. A corner foot 4 is shown in the corner region of bottom part 2; its front edge 5 projects beyond the related bottom corner edge 6. A nub-like elevation 7 is formed onto this projecting front edge 5. Nub-like elevation 7 therefore forms the front delimitation of a bay-like depression 8 in the corner region of circumferential groove 3.

Collar-like projections 9 that reach into groove 3 at a right angle serve as a reinforcement and wear protection for the corner region, which is subject to great stress.

As a reinforcement and wear protection for nub-like elevation 7, a screw 10 is screwed into elevation 7, reaching far into the foot.

In addition to the task of wear protection and stabilization, screw 10 has the further function of attaching a tab 11. Tab 11 is made from an elastic material (for example, plastic), and runs out of a horizontal region, through which screw 10 passes, in arc shape, at a right angle, upward, and lies against bottom corner edge 6 with its free end 12, which is angled off slightly toward the outside.

The securing belt is pushed counter to the elastic force of tab 11, from above, between tab 12 and bottom corner edge 6, until it comes to lie in the region of groove 3. Here, it is secured against slipping out toward the front, by means of tab 11 and nub-like elevation 7.

Accordingly, while only a few embodiments of the present invention have been shown and described, it is obvious that many changes and modifications may be made thereunto without departing from the spirit and scope of the invention.

What is claimed is:

1. A load carrier comprising:

a rectangular bottom part having corner regions with corner edges;

feet disposed at least in the corner regions of the bottom part; and a groove for accommodating a load-securing belt provided above the feet, encircling the bottom part, wherein a front edge of each foot disposed in a corner region projects beyond a related bottom corner edge, and wherein a nub-like elevation is provided on said projecting front edge.

2. The load carrier according to claim 1, wherein the elevation is a formed part provided on the projecting front edge and integrated into the foot.

3. A load carrier comprising:

a rectangular bottom part having corner regions with corner edges;

feet disposed at least in the corner regions of the bottom part, wherein a front edge of each foot disposed in a corner region projects beyond a related bottom corner edge, and a nub-like elevation is provided on said projecting front edge;

a groove for accommodating a load-securing belt provided above the feet, encircling the bottom part; and a screw that reaches into the foot, said screw being inserted into a peak point of the elevation, wherein a head of said screw forms an upper elevation cover.

4. The load carrier according to claim 3, wherein the elevation is a separate part and is disposed below the head of the screw, wherein the screw is screwed into a thread introduced into the foot.

5. The load carrier according to claim 3, further comprising a flexible tab that reaches up to a bottom corner edge and lies on said corner edge with a free end, said tab being held by the screw.

6. A load carrier comprising:

a rectangular bottom part having corner regions with corner edges;

feet disposed at least in the corner regions of the bottom part; and a groove for accommodating a load-securing belt provided above the feet, encircling the bottom part, wherein a front edge of each foot disposed in a corner region projects beyond a related bottom corner edge, wherein a nub-like elevation is provided on said projecting front edge, and wherein the foot is configured from a sleeve formed from a wear-resistant material, said sleeve being set onto a stump formed onto an underside of the load carrier.

* * * * *